United States Patent [19]

Stockton

[11] 4,010,896

[45] Mar. 8, 1977

[54] MODULAR LIQUID COLLECTION SYSTEM FOR RAILROAD ROADBEDS

[76] Inventor: William N. Stockton, 2706 N. 55th St., Omaha, Nebr. 68104

[22] Filed: Mar. 25, 1976

[21] Appl. No.: 670,145

[52] U.S. Cl. ..... 238/2; 238/7

[51] Int. Cl.[2] ..... E01B 1/00; E01C 9/06

[58] Field of Search ..... 238/1, 2, 6, 7, 8, 5, 238/9; 104/133; 134/123; 404/2, 3

[56] References Cited

UNITED STATES PATENTS

| | | | |
|---|---|---|---|
| 2,137,566 | 11/1938 | Clare | 238/8 |
| 2,652,981 | 9/1953 | Lanier | 238/9 |
| 3,658,590 | 4/1972 | Huebner et al. | 134/123 X |
| 3,773,255 | 11/1973 | Schoolties et al. | 238/2 |

*Primary Examiner*—Robert J. Spar
*Assistant Examiner*—Randolph A. Reese
*Attorney, Agent, or Firm*—Robert A. Ostmann

[57] ABSTRACT

The disclosure concerns a modular liquid collection system for use on the roadbed of a railroad, particularly at fueling stations. The modules are arranged end-to-end along the track, and are composed of precast components made of reinforced concrete or foamed plastic. In the most complete form, each module includes a central basin which rests on the ties between the rails, and a pair of side basins which rest on the ties at the outboard sides of the rails and which are formed with integral curbs. The basins have liquid-receiving surfaces which are pitched in both the transverse and longitudinal directions and have centrally located drain openings which overlie a transverse drain trough. The basins of the end modules of a series are equipped with removable end curbs.

23 Claims, 6 Drawing Figures

MODULAR LIQUID COLLECTION SYSTEM FOR RAILROAD ROADBEDS

BACKGROUND AND SUMMARY OF THE INVENTION

It is desirable, from the standpoint of both pollution abatement and economics, to collect and salvage the diesel fuel spilled at railroad fueling stations. In the past, two types of collection systems have been used for this purpose. The first type uses permanent concrete pits and aprons. This apparatus is quite expensive, and its construction requires considerable time. The second kind of collection system is modular in nature and employs a series of pans made of sheet metal or fiberglass which are installed on the ties, and cross drains of similar material which are positioned between the ties. While these modular systems can be installed more easily and are less costly than the permanent systems, they too have undesirable characteristics. The chief disadvantages are:

a. The use of specialized components which usually cannot be obtained or fabricated in the locality of the fueling station.
b. A relatively large number of separate components.
c. The lack of durability.
d. The need for including costly metal gratings to provide secure footing for railroad crews.
e. The necessity, in some instances, to drill attachment holes in the rails and to take special measures to provide electrical insulation.

The object of this invention is to provide an improved form of modular liquid-collecting system. According to the invention, the modules employ precast components made of reinforced concrete or foamed plastic which are retained in place by reason of their own weight and shape and without the need for special rail or tie attachments. Each module comprises at least one basin which rests on the ties, and a cross drain which is posititioned in the ballast between ties. A complete module comprises three basins, one being designed to fit between the rails and other being designed for use at the outboard sides of the rails. All basins are formed with integral, depending locking means which coact with tie side faces to limit movement of the basin in the direction of the rails, and with a liquid receiving surface defined by four planar faces which slope downward toward a centrally located drain opening which overlies the cross drain. The side or outboard basins are formed with integral longitudinal curbs, and separate, removable end curbs are provided for the terminal modules of an end-to-end series.

The new modular collection system is especially desirable because it is inherently durable, requires only a few components which can be fabricated locally by railroad personnel using readily available materials, and can be installed quickly and easily on existing roadbeds. In addition, the basins themselves are self-draining and otherwise inherently provide secure footing, so auxiliary gratings are not needed. Finally since the components are electrically non-conductive, they are inherently safer for the workmen and can be installed on signaled track without any modification.

BRIEF DESCRIPTION OF THE DRAWINGS

The preferred embodiment of the invention is described herein with reference to the accompanying drawings, in which.

DESCRIPTION OF PREFERRED EMBODIMENT

Figure 1:
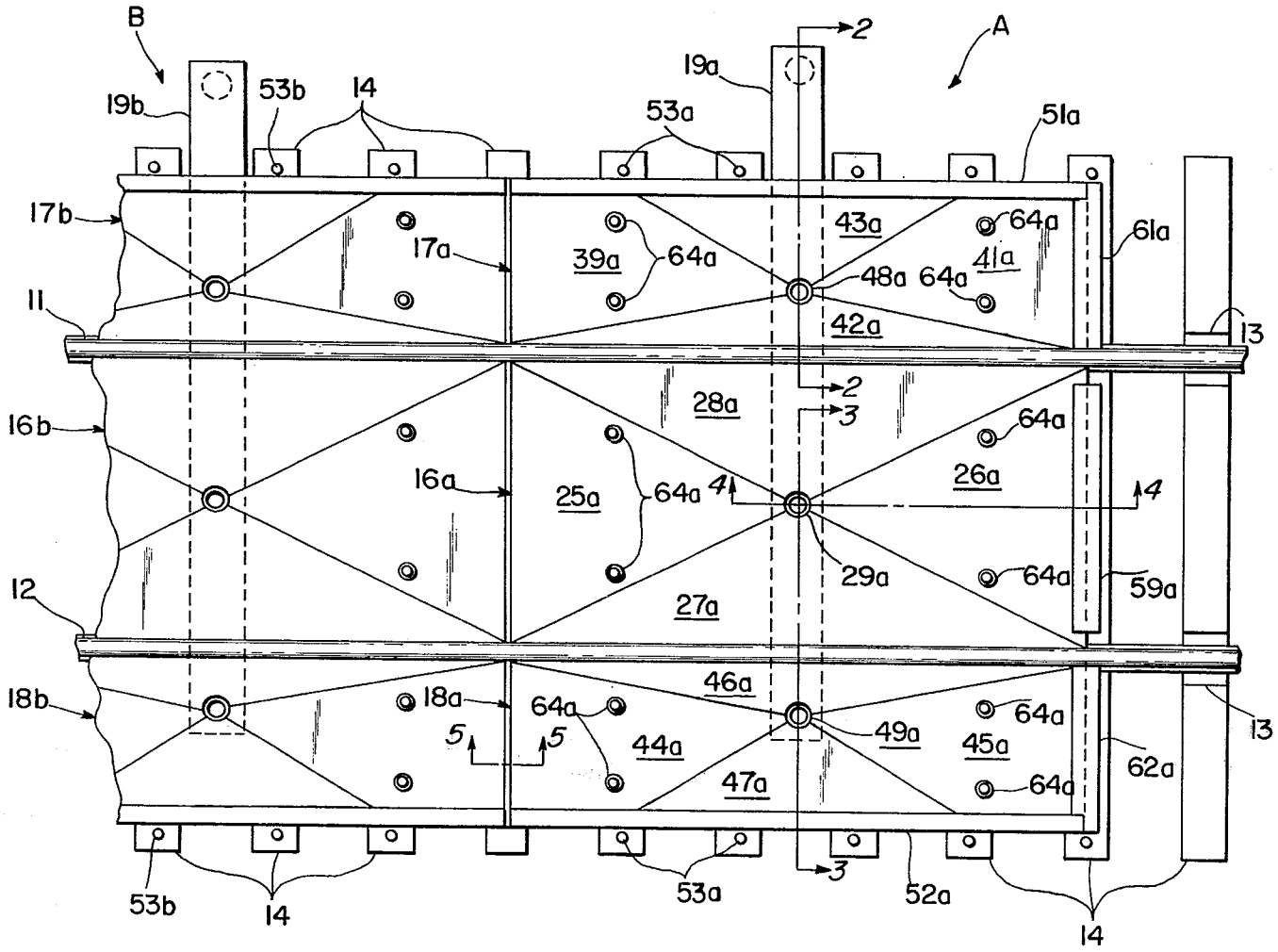
FIG. 1 is a plan view of a portion of a roadbed incorporating the improved collection system.

As shown in the drawings, the new modular collection system in its fullest is applied to a roadbed which includes a pair of welded rails 11 and 12 which are carried by tie plates 13 attached to switch ties 14 embedded in compacted ballast (not shown). The system comprises a series of modules, two of which are illustrated at A and B, arranged end-to-end along the roadbed. Except as noted below, the modules employ identical components. Therefore, corresponding parts are identified by the same reference numerals, with postscripts *a* and *b* being used to distinguish one set of parts from the other.

Collection module A comprises a basic set of four precast components, namely, a central basin 16*a*, two outboard basins 17*a* and 18*a*, and a cross drain 19*a*. These parts, as well as the other precast elements of the system mentioned later, are made of concrete and are reinforced by steel rods indicated generally by the dot-dash lines and solid circles 21*a*. Central basin 16*a* is of rectangular shape in plan view and has a length equal to a multiple (e.g. 5) of the centerline spacing of ties 14. The width of basin 16*a* is slightly greater (for example, 1 inch greater) than the transverse distance between the heads of rails 11 and 12, so that the unit can be fitted into the space between the rails, yet have its sides closely adjacent the rail webs. The height of the basin is so chosen that the upper side corners are positioned opposite the head-web fillets of the rails.

Figure 4:
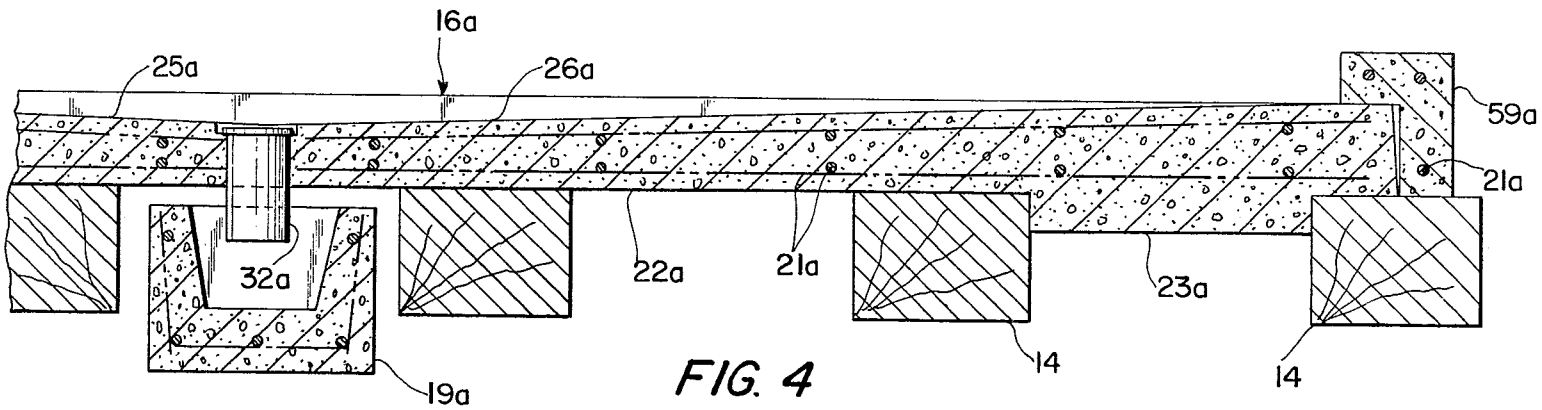

Basin 16*a* is formed with a flat, planar bottom surface 22*a* over most of its area in order that it will rest securely on the upper faces of the ties. However, adjacent each end, this component is provided with an integral, depending locking projection 23*a* (see FIG. 4) which fits between a pair of adjacent ties 14 and engages the oppositely directed side faces of those ties. This arrangement prevents any substantial shifting of the basin in the direction of the rails. The bottom of basin 16*a* also is formed with a recess 24*a* which extends longitudinally along each side, and which provides clearance for the adjacent rail base, tie plate 13 and spike heads (not shown).

Figure 6:
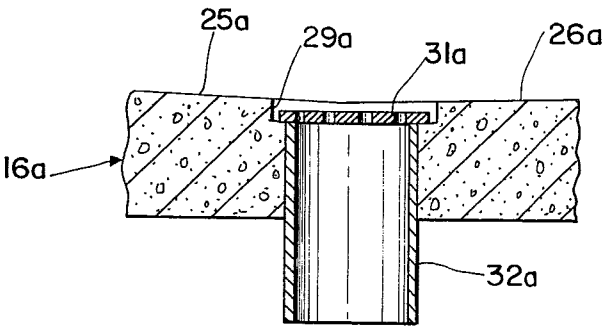
FIG. 6 is an enlarged view of a portion of FIG. 4.

The upper, liquid-receiving surface of basin 16*a* is defined by four planar faces 25*a*–28*a* which slope downward from the basin margins and converge toward a centrally located drain opening 29*a* extending through the unit. The size of the basin and the pitch of these faces is selected to insure runoff of liquid, to thereby preclude the formation of pools. As shown in FIG. 6, the drain opening preferably is fitted with a perforated plate strainer 31*a*, from which depends a waste pipe 32*a*.

The outboard basins 17*a* and 18*a* are sized to cover most of the exposed area of ties 14 at the outboard sides of rails 11 and 12, respectively, without overhanging the ends of the ties. These units are illustrated as indentical, but one may be wider than the other depending upon the requirements of a particular installation. In any event, they have the same length and height as central basin 16*a* and are constructed in a similar way. Thus, each outboard basin includes a flat, planar bearing face 33*a* or 34*a* which engages the upper surfaces of the ties, integral locking projections 35*a* or 36*a*, a clearance recess 37*a* or 38*a* running along the side adjacent the rail 11 or 12, a liquid-receiving surface defined by a set of four planar, sloping faces 39*a*, 41*a*, 42*a* and 43*a* or 44*a*, 45*a*, 46*a* and 47*a*, and a central drain opening 48*a* or 49*a* equipped with a strainer and waste pipe. However, in contrast to central basin 16*a*, each of the outboard basins is formed with an integral curb 51*a* or 52*a* which extends longitudinally along the upper margin of its exposed side and which projects above the liquid-receiving surface. Although, because of their size and weight and the inclusion of locking projections, the outboard basins require no auxiliary fasteners to hold them in place, as a safety precaution it is recommended that they be restrained against transverse movement away from the rails by spikes 53*a* driven into the ties alongside the basins.

Figure 2:
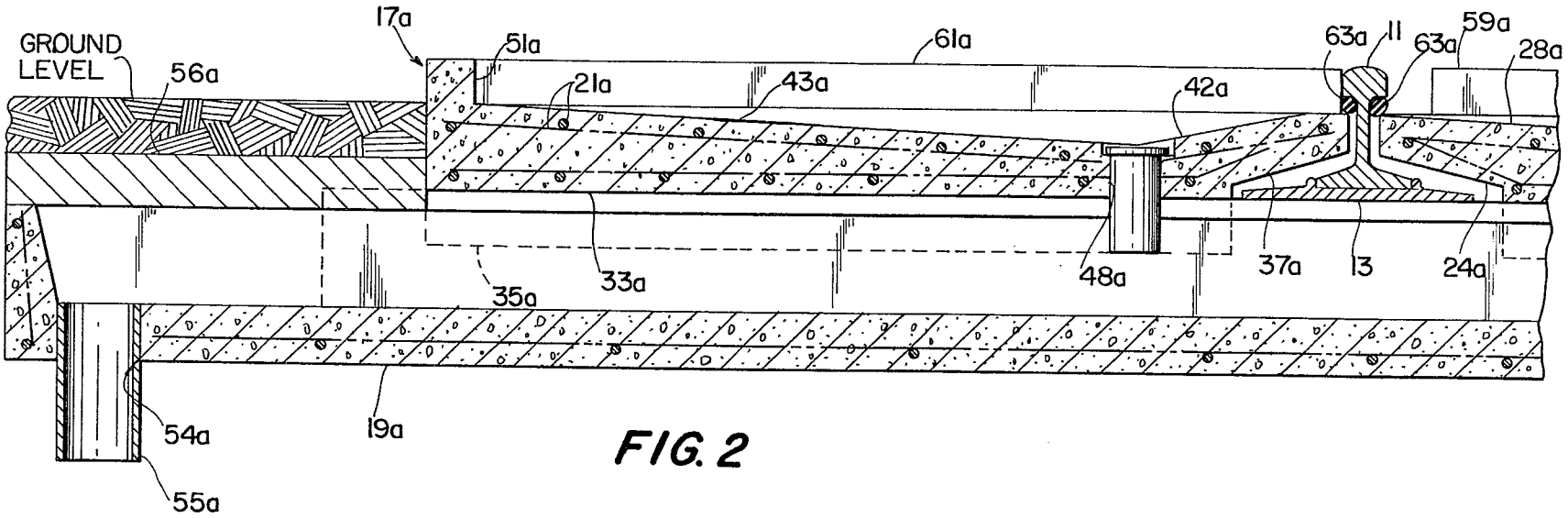
FIGS. 2–5 are enlarged sectional views taken on lines 2—2 to 5—5, respectively, of FIG. 1.
Figure 3:
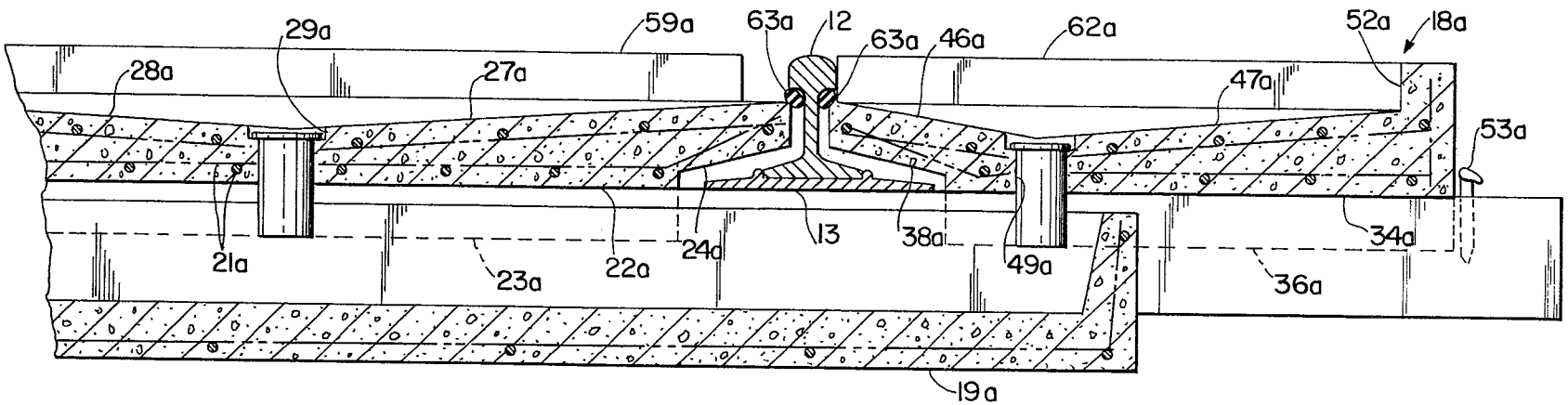

The cross drain 19*a* of module A is simply a trough with closed ends which rests in the ballest between an adjacent pair of ties 14 and below the drain openings 29*a*, 48*a* and 49*a* of the three basins. The drain extends about 2 feet beyond the ends of the ties at one side of the roadbed, and near its end it is formed with a bottom discharge opening 54*a*. This opening is fitted with a waste pipe 55*a* which is joined to a common collection pipe (not shown) that runs in the direction of the roadbed and interconnects the various modules. Since, as indicated in FIG. 2, the cross drain 19*a* is below ground level, the portion outboard of basin curb 51*a* is covered by a treated wood plank 56*a*.

Figure 5:
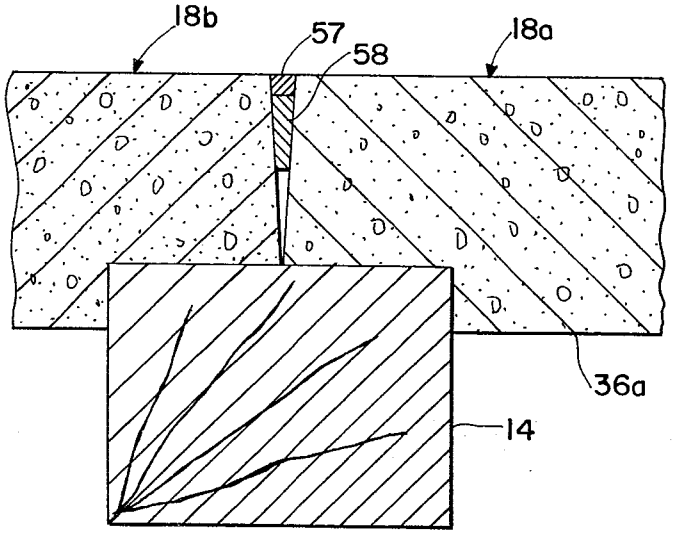

Referring to FIG. 5, it will be observed that the end faces of the basins are beveled to provide a wedge-shaped gap at the junction between abutting modules. The gap has a maximum width of about one-half inch, and is sealed by a suitable oil resistant compound 57 which overlies a caulked backing 58.

The terminal modules of the series, of which module A is one, are provided with removable, precast curbs 59*a*, 61*a* and 62*a* which extend across the exposed ends of the basins 16*a*, 17*a* and 18*a*, respectively. These curbs are of L-shape in cross section, each having a horizontal leg which rests at its side on the associated basin and a vertical leg which bears endwise against the top of the underlying tie 14. As in the case of the basins themselves, the depending legs of the removable curbs are formed with recesses to provide clearance for the rail bases and the tie plates. Each of the curbs 61*a* and 62*a* extends across practically the full width of the associated outboard basin 17*a* or 18*a*, but the center curb 59*a* is made considerably shorter than the width of basin 16*a* in order to provide clearance for the flanges of the train wheels. Inclusion of the curbs, both integral and removable, is desirable because these parts prevent overflow in the event of massive spillage, and also because they tend to keep the basins free of dirt and gravel.

In the interests of minimizing the risk of escape of diesel fuel from the collection system, it is desirable to provide some sort of seal between the rails and the adjacent margins of the basins. The illustrated modules include such seals, each of which takes the form of a length of neoprene hose 63*a* which is compressed between the head-web fillet of the rail and the adjacent upper basin corner.

The recommended concrete mix for the precast components employs Type III cement and an agregate having a maximum size of ½ inch, and has approximately 7 percent entrained air. This mix provides a compressive strength of 2,000 p.s.i. at 3 days and 5,000 p.s.i. at 28 days. It is also recommended that the exposed edges of both the integral and the removable curbs be slightly rounded, and that the upper surfaces of all basins be given a slightly rough, anti-skid finish. Finally, since the basins are relatively heavy, each should be provided with a set of inserts 64*a* into which the eye bolts used for power hoisting can be threaded.

Although it is presently preferred that the precast parts be made of concrete, the foamed plastic used as a substitute for concrete in railroad crossings may be employed.

This change would substantially reduce the weight of the parts, but only at the expense of increasing cost, and also perhaps making local fabrication impractical. It also should be observed that, while the illustrated system employs complete modules, i.e., modules having three basins, it will be evident that any basin or combination of two basins could be used in situations where the liquid-collecting capability of such a simplified arrangement is deemed sufficient.

I claim:

1. A liquid collection system for the roadbed of a railroad which includes a pair of parallel rails supported by longitudinally spaced ties, the system comprising a. a series of collection modules arranged end-to-end along the roadbed and each of which includes at least one rectangular precast basin which rests on a group of ties and extends alongside at least one of the rails, b. said basin having an upper, liquid-receiving surface defined by four planar faces which slope downward and direct liquid flow toward a centrally located drain opening, c. said basin also having internal locking means arranged to engage oppositely directed tie side faces to limit movement of the basin in the direction of the rails, d. each module also including a precast drain trough located between an adjacent pair of ties beneath said drain opening and extending transversely of the roadbed to a region beyond one end of the ties, and e. the drain trough having a discharge opening at said region.

2. A system as defined in claim 1 in which each end module of said series includes a removable, precast curb which extends across the exposed end of the associated basin.

3. A system as defined in claim 2 in which a. the basins of the series of modules are located adjacent the outboard side of a rail; and b. each basin has an integral curb extending longitudinally along its exposed side.

4. A system as defined in claim 2 in which a. each module includes at least two of said basins, b. one basin being located adjacent the outboard side of a rail and having an integral curb extending longitudinally along its exposed side, and the other basin being located between the rails and having opposite sides positioned closely adjacent the inboard sides of the rails;

c. the centrally located drain openings of the basins of each module overlie the drain trough of the module; and d. each basin of the end modules of the series has one of said removable curbs at its exposed end.

5. A system as defined in claim 2 in which
a. each module has three of said basins,
b. one basin being located between the rails and having opposite sides positioned closely adjacent the inboard sides of the rails, the second basin being located adjacent the outboard side of one of the rails, and the third basin being located adjacent the outboard side of the other rail,
c. the second and third basins having integral curbs extending along their exposed sides;
d. the drain openings of the three basins and each module overlie the drain trough of the module; and
e. each basin of the end modules of the series has one of said removable curbs at its exposed end.

6. A system as defined in claim 1 in which said four planar faces are of triangular shape in plan view and converge toward said centrally located drain opening.

7. A system as defined in claim 1 in which each module includes an elongated, resilient sealing member which is compressed between a corner of the basin and the headweb fillet of the adjacent rail.

8. A system as defined in claim 1 in which said four planar faces have a rough, anti-skid finish.

9. A system as defined in claim 1 in which
a. the end faces of each basin are beveled, whereby the abutting ends of the basins of adjacent modules define a vertical, wedge-shaped gap; and
b. which includes sealing means received in said gap.

10. A liquid collection module for use on a railroad roadbed which includes a pair of parallel rails supported by longitudinally spaced ties, the module comprising a rectangular, precast basin having a length which permits it to span a plurality of ties and a width which enables it to fit along-side the outboard side of a rail without overhanging the adjacent ends of the ties, the basin including
a. a bottom having a flat, planar bearing surface arranged to rest on the upper faces of the ties, depending, integral locking means arranged to engage oppositely directed tie side faces to limit movement of the basin in the direction of the rails, and a longitudinally extending recess at its inboard side which is sized and shaped to provide clearance for the rail base and its attachments to the ties;
b. a centrally located drain opening extending vertically through the basin; and
c. a top having a liquid-receiving surface defined by four planar faces which slope downward and direct liquid flow toward said drain opening, and an integral curb which extends longitudinally along the outboard side of the basin and projects above the liquid-receiving surface.

11. A module as defined in claim 10 in which the locking means comprises two projections which are located near opposite ends of the basin and extend in the direction of the basin width, each projection having two faces arranged to abut the opposing side faces of a pair of adjacent ties.

12. A module as defined in claim 10 in which said four planar faces are of triangular shape in plan view and converge toward said drain opening.

13. A module as defined in claim 10 which includes a removable, precast curb which extends across the basin at one of its ends and projects above the liquid-receiving surface.

14. A module as defined in claim 13 in which the removable curb is of L-shape in cross section and has a horizontal leg which rests at its side on the basin and a vertical leg which lies along the end face of the basin and is arranged to bear at its end on the top of an underlying tie.

15. A module as defined in claim 10 in which said four planar faces having a rough, anti-skid finish.

16. A module as defined in claim 10 in which the end faces of the basin are beveled so that when two basins are abutted end-to-end they define a vertical, wedge-shaped gap.

17. A liquid collection module for use on a railroad roadbed which inludes a pair of parallel rails supported by longitudinally spaced ties, the module comprising a rectangular, precast basin having a length sufficient to span a plurality of ties and a width which enables it to be placed between the rails with its sides closely adjacent the rail webs, the basin including
a. a bottom having a flat, planar bearing surface arranged to rest on the upper faces of the ties, depending, integral locking means arranged to engage oppositely directed tie side faces to limit movement of the basin in the direction of the rails, and a longitudinally extending recess at each side which is sized and shaped to provide clearance for the adjacent rail base and its attachments to the ties;
b. a centrally located drain opening extending vertically through the basin; and
c. a top having a liquid-receiving surface defined by four planar faces which slope downward and direct liquid flow toward the drain opening.

18. A module as defined in claim 17 in which the locking means comprises two projections which are located near opposite ends of the basin and extend in the direction of its width, each projection having two faces arranged to abut the opposing side faces of a pair of adjacent ties.

19. A module as defined in claim 17 in which said four planar faces are of triangular shape in plan view and converge toward said drain opening.

20. A module as defined in claim 17 which includes a removable, precast curb which extends across the basin at one of its ends and projects above the liquid-receiving surface.

21. A module as defined in claim 20 in which the removable curb is of L-shape in cross section and has a horizontal leg which rests at its side on the basin and a vertical leg which lies along the end face of the basin and is arranged to bear at its end on the top of an underlying tie.

22. A module as defined in claim 17 in which said four planar faces have a rough, anti-skid finish.

23. A module as defined in claim 17 in which the end faces of the basin are beveled so that when two basins are abutted end-to-end they define a vertical, wedge-shaped gap.

* * * * *